United States Patent [19]

Legendre et al.

[11] Patent Number: 4,904,119

[45] Date of Patent: Feb. 27, 1990

[54] PROCESS FOR PLACING A PILING IN THE GROUND, A DRILLING MACHINE AND AN ARRANGEMENT FOR IMPLEMENTING THIS PROCESS

[75] Inventors: Yves Legendre, Balloy; Hervé Barthelemy, Croissy/sur/Seine, both of France

[73] Assignee: Soletanche, Naterre, France

[21] Appl. No.: 109,946

[22] Filed: Oct. 19, 1987

[30] Foreign Application Priority Data

Oct. 22, 1986 [FR] France ..... 86 14657

[51] Int. Cl.[4] ..... E02D 7/28

[52] U.S. Cl. ..... 405/228; 175/57; 405/233

[58] Field of Search ..... 405/227, 228, 232, 233; 175/9, 57, 263, 266, 267

[56] References Cited

U.S. PATENT DOCUMENTS 1,786,484 12/1930 Duda .
2,287,714 6/1942 Walker .
2,375,335 5/1945 Walker .
3,710,878 1/1973 Endo et al. .
4,133,396 1/1979 Tschirky .
4,154,552 5/1979 Van Bilderbeek .

FOREIGN PATENT DOCUMENTS 838833 8/1958 United Kingdom .
2010360 12/1978 United Kingdom .

*Primary Examiner*—David H. Corbin
*Attorney, Agent, or Firm*—Schweitzer & Cornman

[57] ABSTRACT

The invention is a method for installing a piling of a predetermined target depth in the ground, particularly on the ocean floor. A pipe is lowered into the ground together with a drilling machine having rotatable cutters movable from a first position in which their transverse dimension is less the inner diameter of the pipe to a second position in which their transverse dimension is greater than the outer diameter of the pipe. The cutters are lowered to a location below the pipe, moved to the second position, and rotated to drill a hole having a diameter larger than the outer diameter of the pipe. After the cutters are retracted and the drilling machine is raised back within the pipe, the pipe and drilling machine are lowered to the bottom of the hole. The steps are repeated until the total target depth is reached. The drilling machine is then removed and the anular space between the wall of the hole and the exterior surface of the pipe is filled with cement.

6 Claims, 8 Drawing Sheets

PROCESS FOR PLACING A PILING IN THE GROUND, A DRILLING MACHINE AND AN ARRANGEMENT FOR IMPLEMENTING THIS PROCESS

BACKGROUND OF THE INVENTION

The present invention concerns, first of all, a process for placing a piling in the ground, particularly in the ocean floor.

In the ocean, foundations for structures are generally made from inclined or vertical pilings with a large diameter (84" or 2.10 m) built with a diesel pile-driver from the surface, or underwater hydraulic pile-drivers.

In certain types of soil, this solution is not satisfactory, however, and an attempt has been made to replace them with drilled cement pilings. In every case, in the range of actual possibilities, rotational drilling is limited to a maximum diameter of 48" (1.20 m) because the take-up coupling is very large, as is the liquid flow for evacuation of the rubble, with direct circulation. Furthermore, it is difficult to use an extension pipe, and to place a pipe in the borehole for the first meters. Finally, it is impossible to drill at the mouth of the borehole.

It has already been proposed, to overcome these disadvantages, that cutting machines such as those described in the French patent No. 85 14939 and 86 05529 be used. These machines, however, do not allow a pipe to be placed in the borehole along its entire length, and furthermore are not intended to make pilings with a circular cross-section.

SUMMARY OF THE PRESENT INVENTION

The present invention is particularly aimed at providing a process which allows implementation of drilled cement pilings with a large diameter, specifically on an ocean floor.

For this purpose, the object of the invention is first of all a process for placing a piling in the ground, particularly on the ocean floor, characterized by the fact that:

(a) the bottom end of a pipe with a pre-determined interior diameter and exterior diameter, containing a drilling machine in its interior, which machine has cutters movable from a first position in which the space they take up transversely is less than the interior diameter of the pipe, to a second position in which the space they take up transversely is greater than the exterior diameter of the pipe, is placed essentially in contact with the ground, (b) at a pre-determined depth, drilling from top to bottom is carried out with the cutters in their said first position, (c) the cutters are placed in their said second position, (d) over-drilling from bottom to top is carried out with the cutters in their second position, to the vicinity of the said bottom end of the pipe, (e) the cutters are returned to their said first position and the machine is withdrawn into the pipe, (f) the pipe is lowered into the hole made in this way, to the said pre-determined depth, and possibly, the operation b) through e) are repeated a certain number of times, and (g) the drilling machine is withdrawn from the pipe driven into the ground in this way, and the annular space between the wall of the hole and the exterior surface of the pipe is cemented.

As an example, a pipe with an interior diameter of 80" (2 m) and a thickness of 2" (5 cm), making an exterior diameter of 84" (2.10 m) can be used to line the borehole. It would then be possible to carry out the drilling from top to bottom at 78" (1.95 m) with the cutters in their retracted position, and to carry out the over-drilling from bottom to top at 90" (2.25 m), with the cutters in their deployed position. The pre-determined depth at which each drilling section can be carried out can be, for example, 3 meters.

It is possible, prior to placing the piling, to put into place an arrangement for holding the pipe and assuring its descent, step by step, into the said hole.

The rate of descent of the pipe can be less than or equal to the depth at which each drilling section is carried out.

In a particular embodiment of the invention, a drilling machine of the type which consists of a head and a body on which the cutters are installed, the head and the body being connected with a jack, can be used, the said head is suspended at the top end of the pipe, at a fixed distance from this end, and the aforementioned drilling and over-drilling operations are carried out by extension and retraction of the said jack.

The invention also has as its object a drilling machine for implementing the process described above, comprising at least one pair of cutters running in counter-clockwise rotation, characterized by the fact that each of the said cutters is installed on an oscillating support, means being provided to change the position of the said supports from one to the other of the two positions where the cutters are in their said first and second position.

To make a piling with a circular cross-section, a drilling machine comprising two pairs of superimposed cutters is preferably used, the total of the four cutters having an essentially circular horizontal projection.

Such an action of the cutters is described in the French patent application No. 84 19053.

Furthermore, it is known that drilling machines of this type, comprising pairs of cutters running in counter-clockwise rotation, often have the disadvantage of leaving an intact step between the cutters, which, depending on the nature of the terrain, can hinder the progress of the cutter.

In order to overcome this disadvantage, it is also provided, according to the present invention, that the cutters are installed on a support which is rotary-mounted on the body of the machine around an essentially vertical axis, with means being provided to make the said support rotate around the said axis.

This rotation of the cutters results in destruction of the step, and therefore in more regular progress of the machine.

Furthermore, it can be provided, to take up the vertical torque created by the rotation of the cutter supports, to use shoes, preferably inflatable ones, installed in longitudinal grooves, which can exert force against the interior surface of the pipe.

The present invention also has as its object an arrangement to hold the pipe and lower it, step by step, for implementing the process described above, characterized by the fact that it comprises a first tightening collar fixed relative to the ground, and a second tightening collar coaxial to the first collar, with means being provided to move the second collar away from and towards the first collar.

An embodiment of the invention will now be described, without limitation, with reference to the schematic diagrams attached, where:

DETAILED DESCRIPTION OF INVENTION

Figure 1:
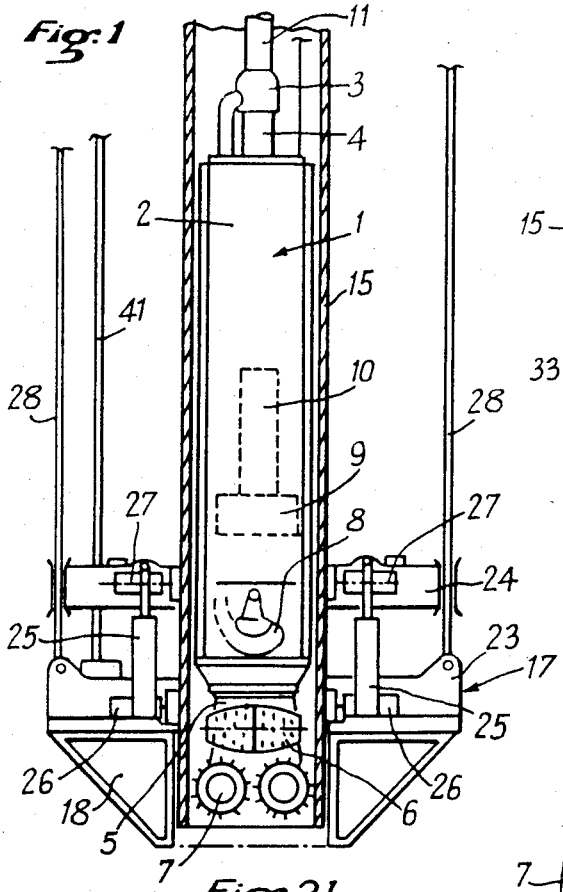
FIG. 1 shows a side view of an assembly which can be used to implement the process according to the invention.

First of all, the arrangement according to the invention will be described in general terms, with particular reference to FIGS. 1 and 6*b*.

The drilling machine 1 used is one which comprises a body 2 and a head 3 connected by an advancing jack 4. At its bottom part, the head 2 holds, by means of a support 5 mounted to pivot around a vertical axis, a pair of upper cutters 6 and a pair of lower cutters 7.

Figure 2A:
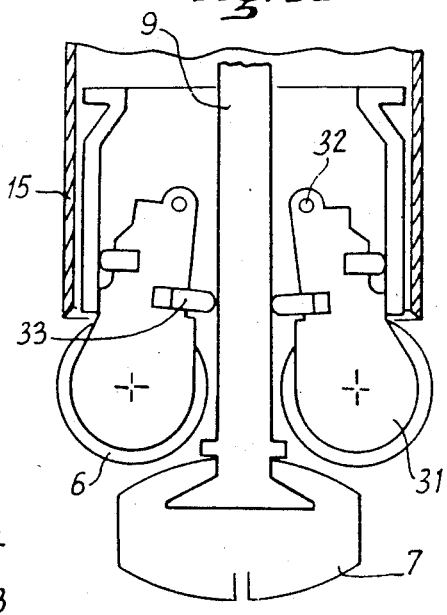
FIGS. 2*a* and 2*b* represent the lower part of the drilling machine with the cutters in their extended and retracted positions, respectively.
Figure 3A:
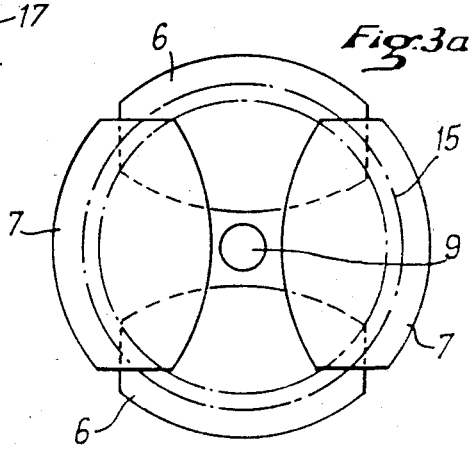
FIGS. 3*a* and 3*b* are bottom views corresponding to FIGS. 2*a* and 2*b*, respectively.
Figure 3B:
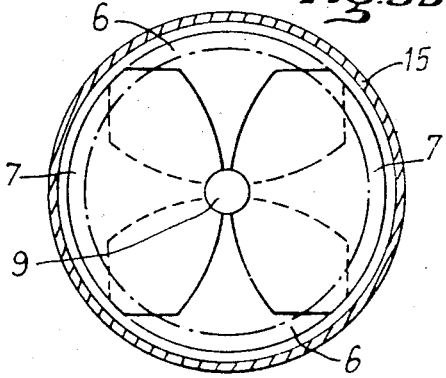

The cutters 6 and 7 are rotary-mounted around essentially horizontal axes, the axes of cutters 7 being perpendicular to the axes of cutters 6. The two cutters 6 rotate counter-clockwise, as towards the vetical axis of the machine, where it is aspirated by a clearing pump 8 by means of an aspiration conduit 9 (FIG. 2*a*). The cutters 6 and 7 have a shape such that their horizontal projection is essentially circular, as can be seen in FIGS. 3*a* and 3*b*, in such a way that the borehohle which they cut has a circular cross-section. Such an action of the cutters is described in the French patent application No. 84 19053.

The driving motors for the pump 8 and the cutters 6 and 7 are supplied with power, for example, by a central hydraulic unit 9 itself driven by an ocean-water turbine 10. This turbine receives ocean water under pressure from a maritime support on the surface, for example a ship with dynamic positioning, by means of a pipeline 11 with two channels and a link system 12. The pipeline 11 is connected, at its lower end, with the head 3 of the drilling machine 1, while the upper end is connected with the link system 12 by means of a distribution box 13. One of the channels of the pipeline 11 allows the turbine to be fed, and the other channel allows the rubble to be evacuated. A flexible pipeline 14 is connected to the distribution box 13 for evacuation of the drilling rubble. Such an action is described in the French patent application No. 86 05529.

Figure 6A:
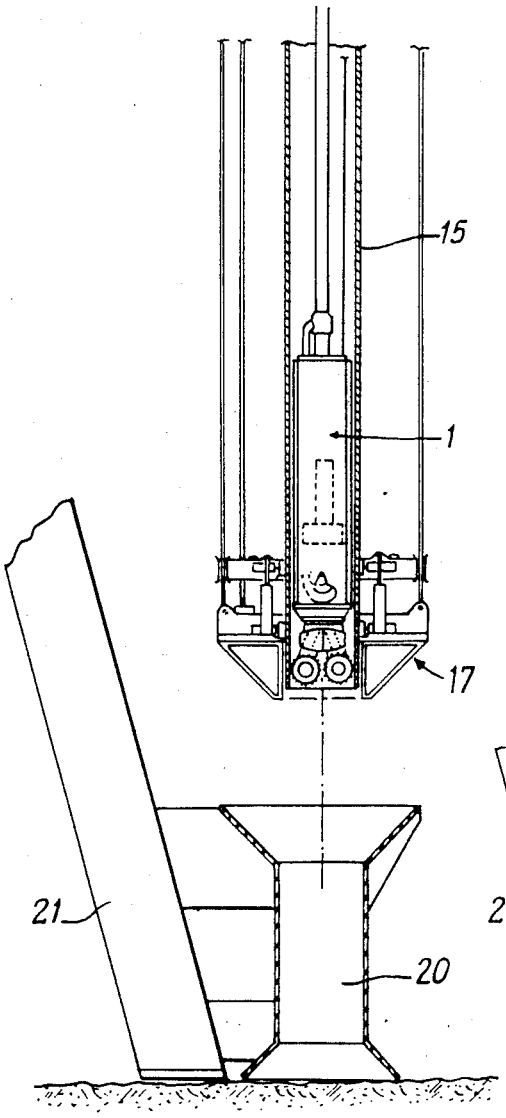
FIGS. 6*a* and 6*l* illustrate different stages of the process according to the invention.
Figure 6B:
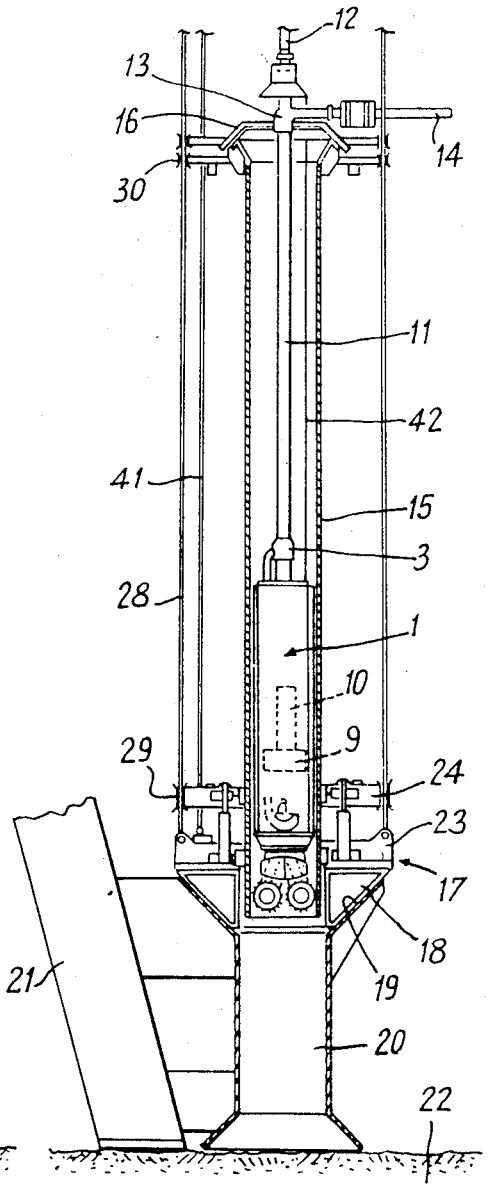

FIGS. 1 and 6*b* furthermore represent the drilling machine 1 arranged inside a pipe 15 which will serve to line the borehole made using the machine.

The drilling machine 1 is supported by the pipe 15 itself, by means of its head 3 and the pipeline with two channels 11, of which the upper end is installed in one piece with the upper end of the pipe 15, by means of a support element 16. The machine 1 is consequently suspended within the pipe 15 by means of the element 16, the head 3 being at a fixed distance from the upper end of the pipe 15, equal to the length of the pipeline 11.

The assembly according to the invention also comprises an arrangement 17 to hold and advance the pipe 15 step by step.

This arrangement 17 comprises, first of all, a guide and support cone 18 which can work together with the upper, widened end 19 of a recess 20 formed in a structure 21 which is planned to be attached to the ocean floor 22 by a piling placed in accordance with the invention.

A lower tightening collar 23 for the pipe 15 is installed in one piece with the cone 18, while an upper tightening collar 24 is installed to be movable axially relative to the collar 23, using maneuvering jacks 25.

Jacks 26 make it possible to tighten the collar 23 around the pipe 15 and jacks 27 make it possible to tighten the collar 24 around the pipe 15.

Guide cables 28 connected to the maritime surface support at constant tension have their lower end attached to the tightening collar 23 and passed through guides 29 and 30, which are attached, respectively, to the upper collar 24 and the upper end of the pipe 15, to assure guidance of the latter during its descent.

The descent of the pipe 15 relative to its holding arrangement and therefore relative to the structure 21 is brought about with the lower collar 23 loosened and the upper collar 24 tightened, by retraction of the jacks 25. This descent can be brought about step by step. In this case, once the jacks 25 have been completely retracted, the collar 23 is tightened and the collar 24 is loosened, then the jacks 25 are deployed in such a way as to make the collar 24 go up again. The collar 24 is then tightened again and the collar 23 is loosened, and the operation is started over again.

Figure 2B:
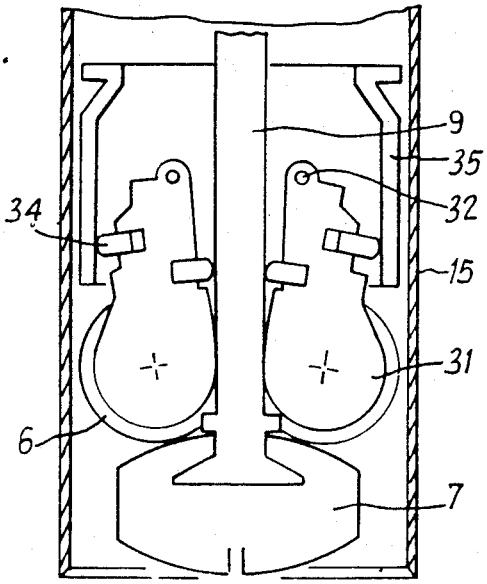

The cutters 6 and 7 can be in either the extended position shown in FIGS. 2*a* and 3*a*, or in a retracted position shown in FIGS. 2*b* and 3*b*.

For this purpose, each cutter 6 is installed on a support 31 which oscillates around a horizontal axis 32. Jacks 33 provide pressure against the pipeline 9 and make it possible to extend the cutters, as shown in FIG. 2*a*. In this case, the horizontal projection of the cutters has a diameter greater than the exterior diameter of pipe 15, as shown in FIG. 3*a*.

At the same time, jacks 34 exert pressure against a peripheral skirt 35 which makes it possible to retract the cutters, as is shown in FIG. 2*b*. In this position, the horizontal projection of the cutters has a diameter smaller than the interior diameter of the pipe 15, which allows the machine 1, including its cutters 6 and 7, to penetrate into the interior of the pipe 15.

It should be understood that oscillating supports and jacks similar to those for cutters 6 are utilized to maneuver the cutters 7.

Figure 4A:
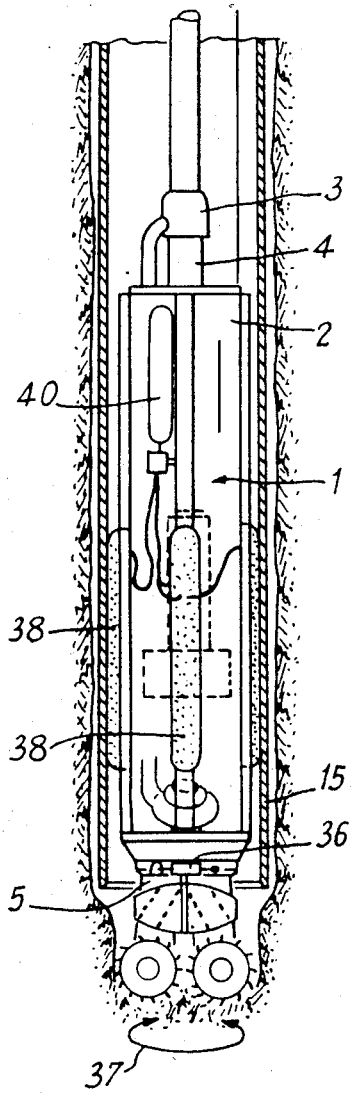
FIGS. 4*a* and 4*b* are a view, in vertical section, of the machine performing a drilling operation, with the lowering jack in the retracted and deployed position, respectively.
Figure 4B:
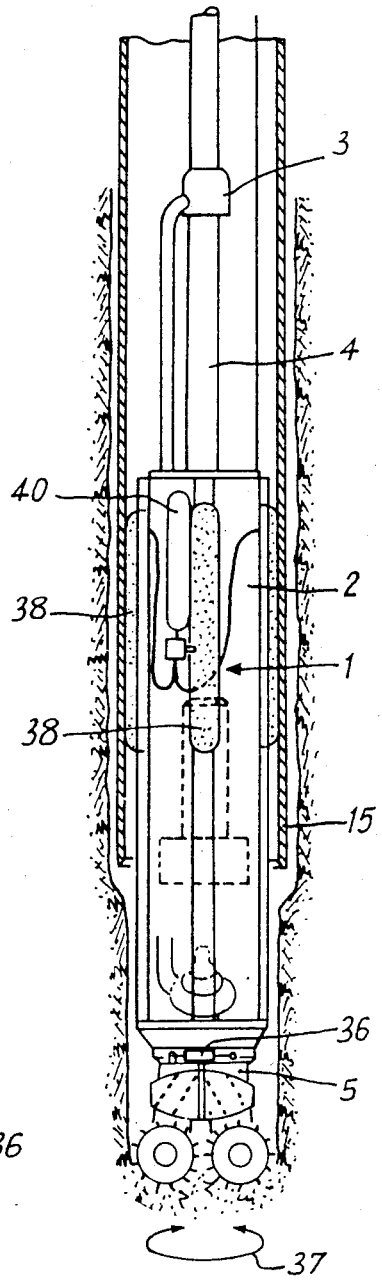
Figure 5:
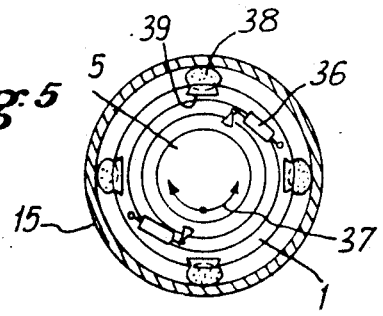
FIG. 5 is a schematic view of FIGS. 4*a* and 4*b* in transversal section.

Referring now to FIGS. 4*a*, 4*b* and 5, one sees that jacks 36 allow a guarantee of rotation of the support 5 of the cutters relative to the body 2 of the drilling machine 1. Is it therefore possible to have these cutters, oscillate, for example by several degrees, around a vertical axis, as shown schematically by the arrows 37, and in this way to break up the step which forms between the two cutters 6 and, respectively, between the two cutters 7.

This oscillation drives a reaction coupling which is taken up by the inflatable shoes 38 which exert pressure against the interior surface of the pipe 15, which can run within grooves 39 of the body 2 of the machine 1. An inflation arrangement 40 is provided in the body of the machine for the shoes 38.

It can be seen in FIGS. 4*a* and 4*b* that the shoes 38, exerting pressure against the pipe 15, stay at the same level by running within the grooves 39 when the body of the machine is lowered as a result of the action of the advancing jack 4.

The assembly according to the invention finally comprises supply cables and a control 41 for the arrangement 17, as well as supply cables and a control 42 for the drilling machine 1.

The process of placing a piling using the assembly described above will now be explained, with reference to FIGS. 6*a* to 6*l*.

FIG. 6*a* represents the assembly composed of the drilling machine 1, the pipe 15 and the holding and advancing arrangement 17 approaching the recess 20 provided in the structure 21. This approach is carried out by holding the assembly suspended by the link system 12 from a maritime surface support which is not shown. It is evident that during the course of this approach, the machine 1 is entirely located inside the pipe 15, the cutters being in their retracted position as shown in FIGS. 2*b* and 3*b*.

In FIG. 6*b*, the guide and support cone 18 has penetrated into the widened opening 19 of the recess 20, thus positioning the assembly relative to the structure 21. The cylindrical part of the recess 20 is provided with an interior diameter slightly greater than the exterior diameter of the pipe 15, in order to permit descent of the latter all the way to the ground, through the recess 20.

It should be understood that it would be possible to place the arrangement 17 directly on the ocean floor, in case it was desired to place an anchor piling prior to putting the structure which it is intended to anchor into place.

Figure 6C:
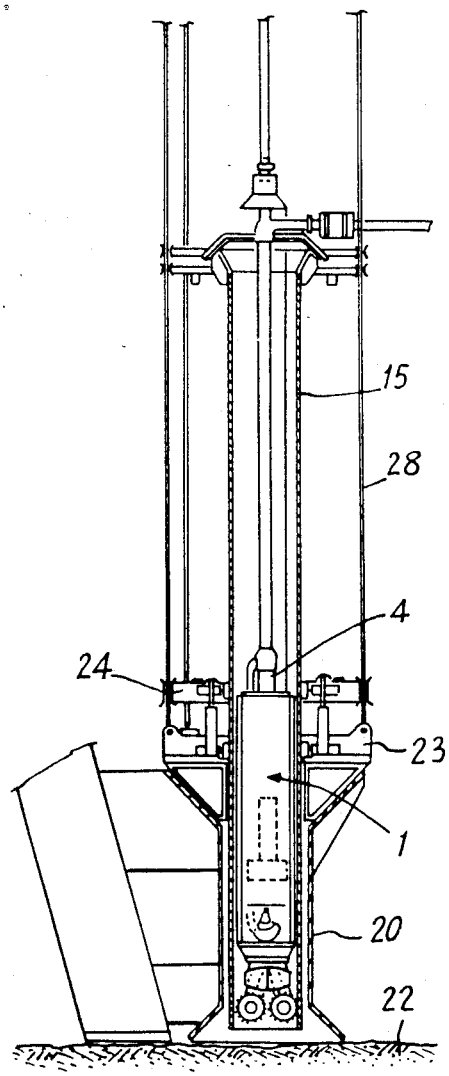

In FIG. 6*c*, the lower end of the pipe 15 and the drilling machine 1 have descended through the recess 20, all the way down to the ground 22. For this purpose, the tightening collars 23 and 24 have been loosened and the pipe 15 is guided on the guide cables 28. This descent is carried out with the advancing jack 4 of the machine 1 in its retracted position.

Figure 6D:
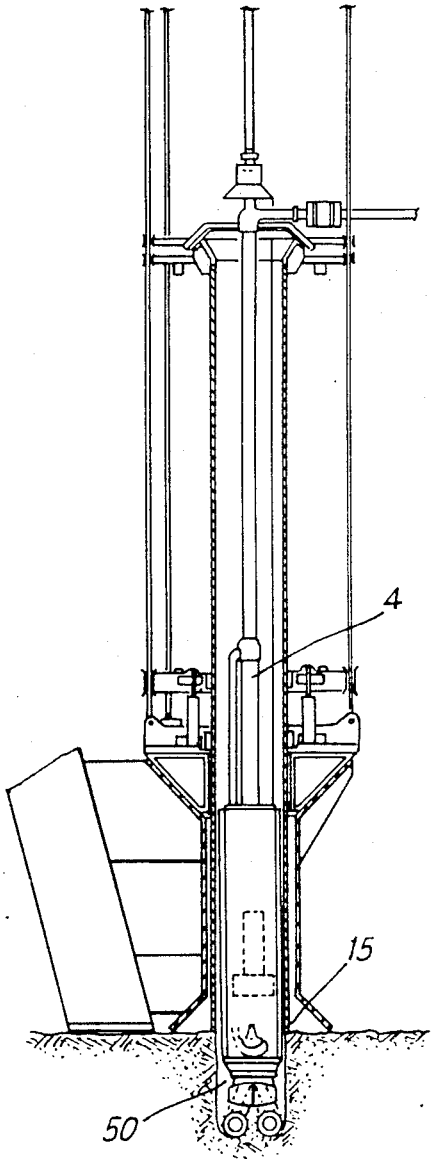

A first drilling pass from top to bottom is then carried out, as shown in FIG. 6*d*, by deploying the advancing jack 4, the cutters remaining in their retracted position of FIGS. 2*b* and 3*b*. A borehole 50 is made in this way, whose diameter is less than the interior diameter of the pipe 15.

Figure 6E:
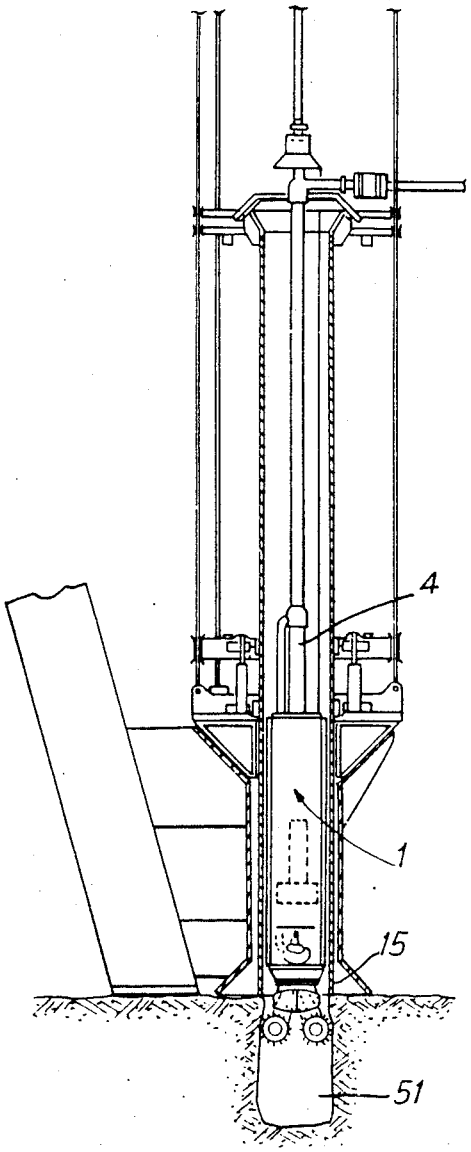

In FIG. 6*e*, the cutters have been extended by means of the jacks 33, to their position as shown in FIGS. 2*a* and 3*a*. An over-drilling borehole 51 is then made from bottom to top, by retracting the advancing jack 4, which brings the cutters of the machine 1 close to the bottom end of the pipe 15.

The hole 51 made in this way consequently has a diameter slightly greater than the exterior diameter of the pipe 15.

Figure 6F:
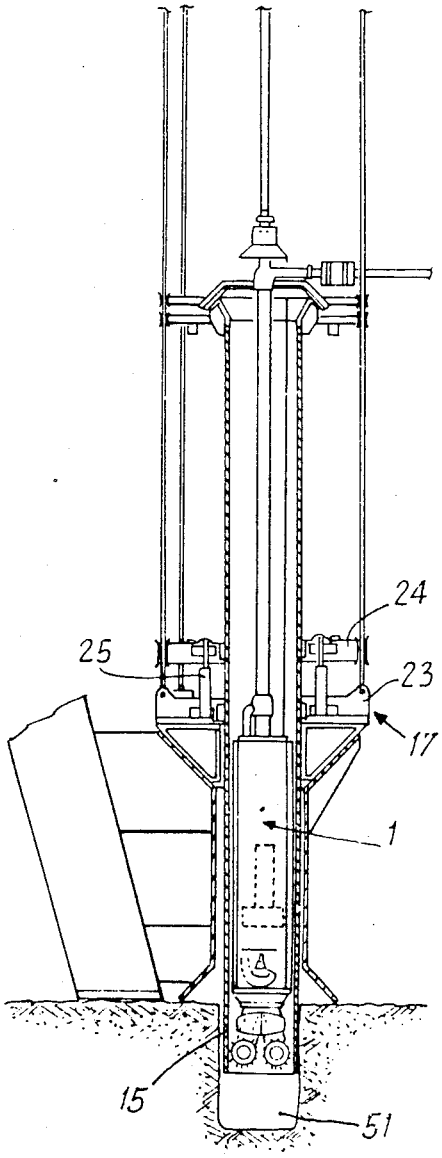

In FIG. 6*f*, the cutters are again retracted by means of the jacks 34, the machine 1 is entirely withdrawn into the pipe 15, and the latter is lowered into the hole 51 by means of the advancing arrangement 17, by the combined action of the tightening collars 23 and 24 and the maneuvering jacks 25, in the manner described above.

Figure 6G:
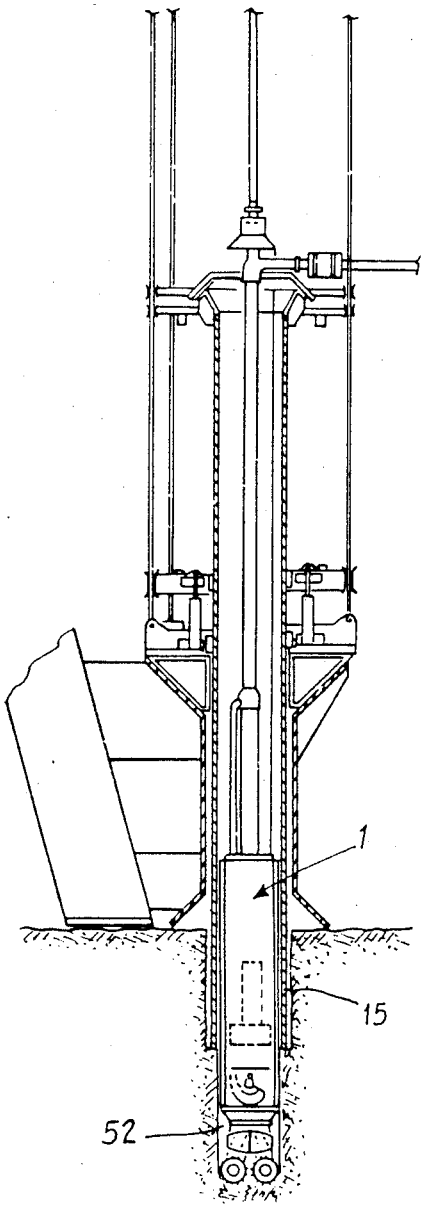

The lower end of the pipe 15 having been brought to the bottom of the hole 51, a new drilling pass to make the borehole 52 is carried out from top to bottom by the drilling machine 1, as shown in FIG. 6*g*.

Figure 6H:
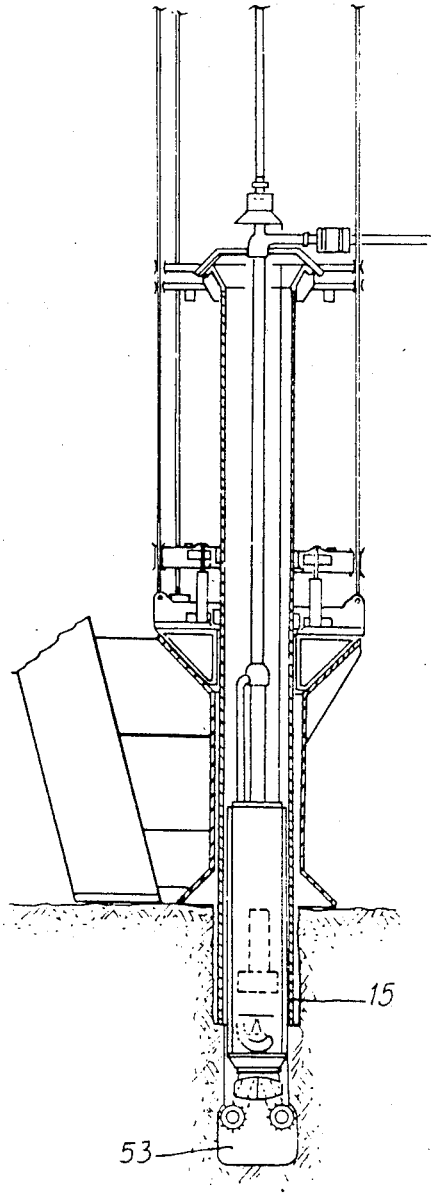

The cutters are then extended and an over-drilling pass to make the borehole 53, which has a diameter greater than the exterior diameter of the pipe 15, is made from bottom to top (FIG. 6*h*).

Figure 6I:
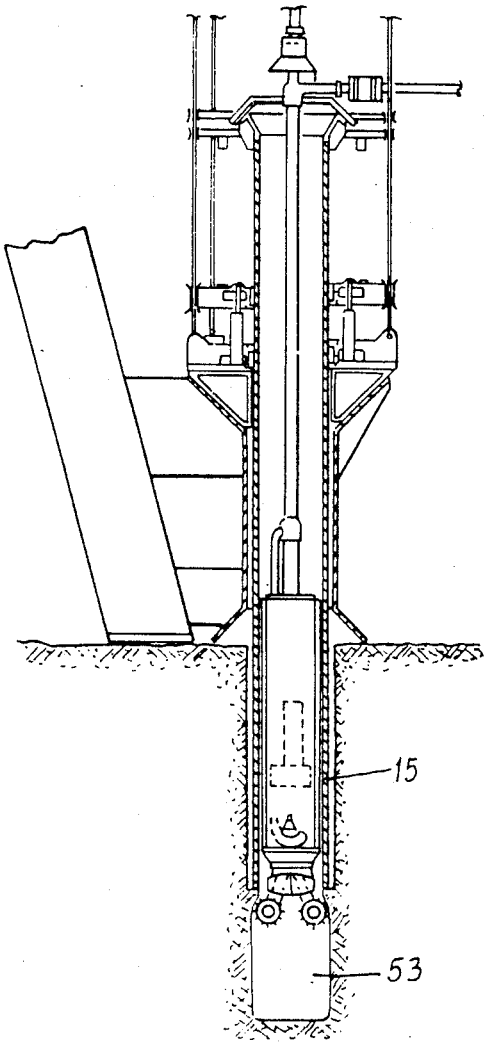
Figure 6J:
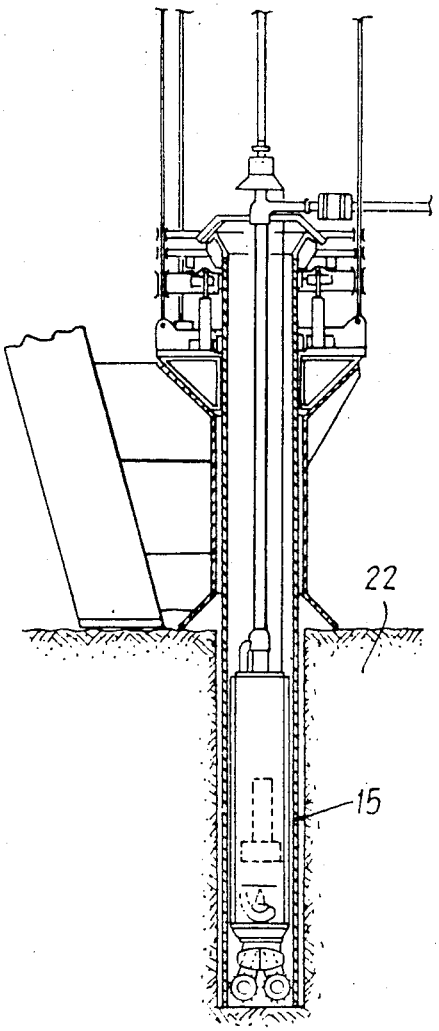

When the over-drilling pass has come close to the bottom end of the pipe 15, as shown in FIG. 6*i*, this pipe can again be lowered all the way to the bottom of the corresponding hole, as shown in FIG. 6*j*.

The above operations can, of course, be repeated as often as necessary to drive the pipe 15 to the desired depth in the ground 22.

Figure 6K:
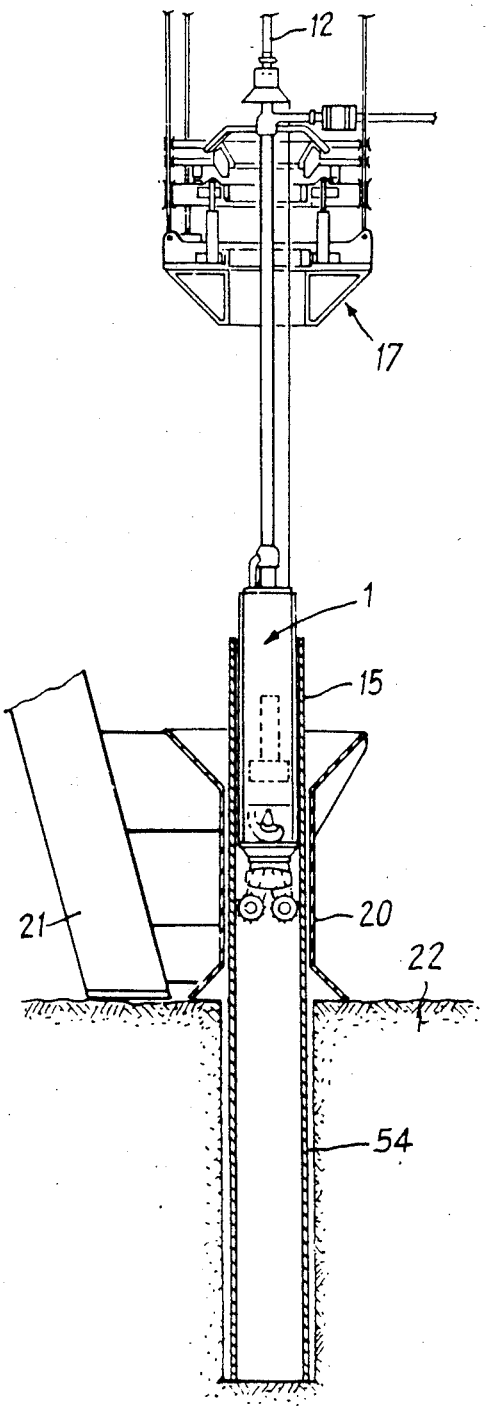

Once the placement has been completed, the arrangement 17 and the drilling machine 1 are raised using the link system 12, as is shown in FIG. 6*k*, leaving the pipe 15 in place in the recess 20 of the structure 21, driven into the ground 22.

Figure 6L:
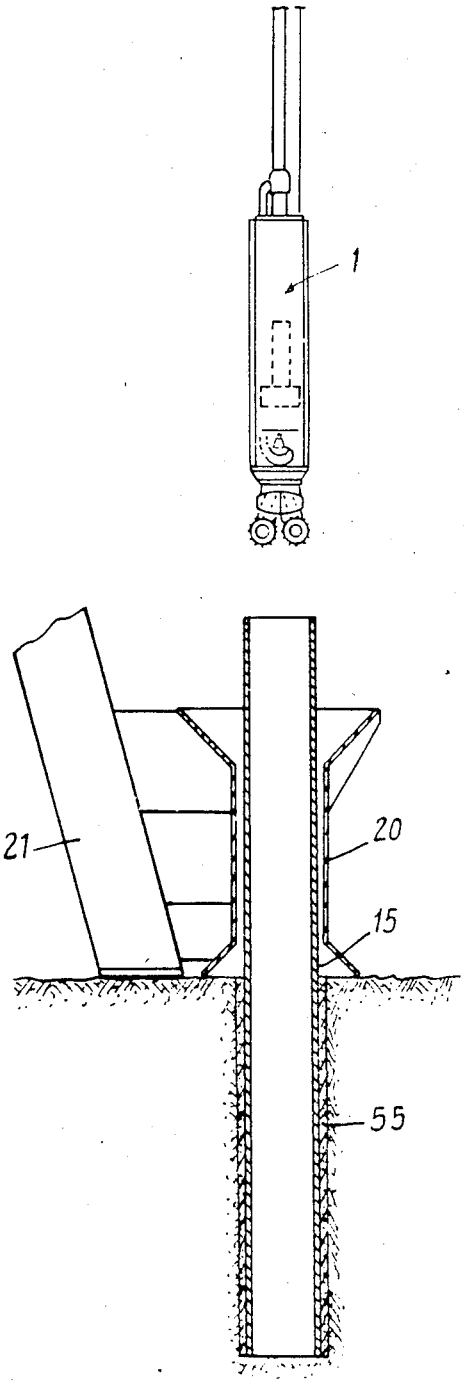

The annular space 54 brought about between the exterior surface of the pipe 15 and the walls of the hole in which the pipe is driven is then cemented by any suitable means, as shown in FIG. 6*l* at 55.

In this way, a circular piling with a large diameter, lined and cemented, and calibrated with precision, has been made.

Of course, variations and modifications can be added to the preceding description, without departing from the scope or the spirit of the invention.

We claim:

1. A method for installing a piling of a predetermined target depth in the ground, particularly on the ocean floor comprising the steps of:

(a) lowering a pipe having predetermined inner diameter and outer diameter into the ground together with a drilling machine set inside said pipe, said machine having rotatable cutters movable from a first position in which their transverse dimension is less than the inner diameter of the pipe to a second position in which their transverse dimension is greater than the outer diameter of the pipe;

(b) holding said pipe fixed while independently lowering the drilling cutters while in said first position to a location below the pipe;

(c) moving said cutters to said second position;

(d) rotating said cutters to drill a hole of a predetermined incremental portion of said target depth, said hole having a diameter larger than the outer diameter of the pipe;

(e) retracting said cutters to their first position and raising the drilling machine back within the pipe;

(f) lowering the pipe and the drilling machine to the bottom of said hole to said incremental portion of said predetermined target depth;

(g) repeating in sequence steps (b) through (f) until the total target depth is reached;

(h) removing the drilling machine from said pipe to establish an annular space between the wall of the hole and the exterior surface of the pipe; and (i) filling said annular space with cement.

2. A method according to claim 1 characterized in that: (a) drilling of said incremental portions of said hole is initially performed from top to botom of the incremental portion with the cutters in their said first position; and (b) thereafter, the cutters are placed in their second position and the drilled hole is reamed from the bottom to the top with the cutters in said second position.

3. A method according to claim 1, wherein prior to step (a) a device for releasably holding the pipe is lowered to the vicinity of the ground in which the piling is to be installed.

4. A method according to claim 3, wherein said device is placed on a guiding structure linked to the piling to be installed.

5. A method according to claim 1, wherein said drilling machine comprises a head and a body on which the cutters are mounted, the head and the body being connected with a jack, said head being linked to the pipe during drilling; said drilling proceeding through extension and retraction of said jack which lowers and raises said drilling machine body.

6. The method of claim 1, including the steps of (a) providing a first tightening collar for the pipe, said first tightening collar having a fixed position relative to the ground, (b) providing a second tightening collar for the pipe; and moving said second collar up and down with respect to said first collar for holding and lowering said pipe.

* * * * *